US006489708B1

(12) United States Patent
Sluyterman et al.

(10) Patent No.: US 6,489,708 B1
(45) Date of Patent: Dec. 3, 2002

(54) LATERALLY SPACED MULTIPLE ELECTRON GUN COLOR CATHODE RAY TUBE DEVICE

(75) Inventors: Albertus A. S. Sluyterman, Eindhoven; Evert Seevinck, Eersel, both of (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/218,548

(22) Filed: Dec. 22, 1998

(30) Foreign Application Priority Data

Dec. 23, 1997 (EP) ..... 97204084
Jun. 30, 1998 (EP) ..... 98202194

(51) Int. Cl.[7] ..... H01J 31/00

(52) U.S. Cl. ..... 313/2.1; 313/1; 313/477 R; 313/408; 313/402; 315/9; 315/13.1

(58) Field of Search ..... 313/1, 2.1, 402, 313/403, 407, 408, 409, 411, 415, 426, 441, 477 R; 315/9, 13.1

(56) References Cited

U.S. PATENT DOCUMENTS

| | | | | |
|---|---|---|---|---|
| 3,184,630 A | | 5/1965 | Geer | 313/70 |
| 4,712,038 A | * | 12/1987 | Takenaka et al. | 313/2.1 |
| 4,777,407 A | * | 10/1988 | Takenaka et al. | 313/2.1 |
| 5,170,102 A | * | 12/1992 | Sluyterman et al. | 313/403 |
| 5,831,373 A | * | 11/1998 | Takahashi et al. | 313/2.1 |
| 6,061,038 A | * | 5/2000 | Washburn | 313/409 |

FOREIGN PATENT DOCUMENTS

| | | | |
|---|---|---|---|
| EP | 0201865 | 11/1986 | H01J/31/20 |
| JP | 3925641 | 9/1939 | |
| JP | 424928 | 2/1942 | |

* cited by examiner

*Primary Examiner*—Nimeshkumar D. Patel
*Assistant Examiner*—Mariceli Santiago

(57) ABSTRACT

A cathode ray tube device in which two deflection yokes and two electron guns are used, but in which only one shadow mask is used. Image uniformity is obtained by creating a partial overlap of the two images created by the two yokes.

15 Claims, 3 Drawing Sheets

LATERALLY SPACED MULTIPLE ELECTRON GUN COLOR CATHODE RAY TUBE DEVICE

BACKGROUND OF THE INVENTION

The present invention relates to a color cathode ray tube device in which the screen section is divided in a plurality of sub-regions and means for separately scanning the sub-regions.

In recent years there has been considerable research aimed at meeting demands relating to high definition color cathode ray tube or associated large-screen high resolution color cathode ray tubes. One requirement for achieving in such tubes is that the electron beam spot on the screen is made smaller. There have also been efforts in the past to improve the electron gun electrode structure and to lengthen and increase the size and aperture of actual electron guns, but results achieved so far have been unsatisfactory. The main reason for this is that the electron gun-to-screen distance becomes larger as a cathode ray tube becomes larger. Thus, the electron gun magnification becomes too large. According, reducing the electron gun-to-screen distance is an important aspect of achieving high resolution. Methods for wide-angle deflection are not practical for this purpose, since they result in an increased difference in magnification between central and peripheral portions of the screen.

In response to this drawback, a structure in which the screens of a plurality of horizontally disposed, independent CRT's are combined into a unitary screen has been proposed in Japanese Utility Model Publication No. 39-25641, Japanese Patent Publication No. 42-4928 and Japanese Patent Disclosure No. 50-17167.

These known structures have, however, the problem that joints are visible between the independent color cathode ray tubes.

BRIEF SUMMARY OF THE INVENTION

It is an object of the invention to provide a cathode ray tube in which the above mentioned problem is reduced or overcome.

To this end a cathode ray tube device in accordance with the invention is characterized in that device comprises a single color cathode ray tube which has, arranged in a linear arrangement, a multitude of necks, deflection yokes and electron guns, but only one shadowmask.

When color displays are provided by tubes such as this, in which the screen section is a unitary section and divided scanning is effected, a color cathode ray tube employing a single shadow mask system for color selection permits simple, but sure, color selection and is very practical.

A color cathode ray tube employing a multi-neck system such as this with a unitary screen structure makes it possible to produce an image that is easy to view, since it eliminates the joints between adjacent cathode ray tubes which occur with an array of independent cathode ray tubes, as described above. The necks are all aligned in a linear arrangement, i.e. substantially along a single line. Preferably an improved image uniformity is obtained by creating a partial overlap of two images created in two adjacent sub-regions. The preferred number of sub-regions is two or three. When two sub-regions are scanned (and thus only two, deflection units etc are used) the device is relatively simple. As the number of sub-regions increase the device gets more complicated.

The use of three sub-regions has the advantage that the overlap regions are not in the middle of the image, whereby the change of annoying visibility of the overlap regions is reduced, while the device as a whole is relatively simple, be it more complicated then for two sub-regions.

The purpose of the invention is to create a CRT with a reduced depth. Other concepts for reduced-depth CRT displays, like the Matsushita "Flat Vision", deviate so much from a conventional CRT that they cannot be manufactured in a normal CRT factory. An approach, in which a two dimensional array of many yokes are used, also deviates significantly from a normal CRT. The cathode ray tube in accordance with the invention requires much less deviation from normal techniques.

BRIEF DESCRIPTION OF THE SEVERAL VIEWS OF THE DRAWING

These and further aspects of the invention will be illustrated in the drawings in which.

The drawings are schematic and in general not to scale.

DETAILED DESCRIPTION OF THE INVENTION

Figure 1:
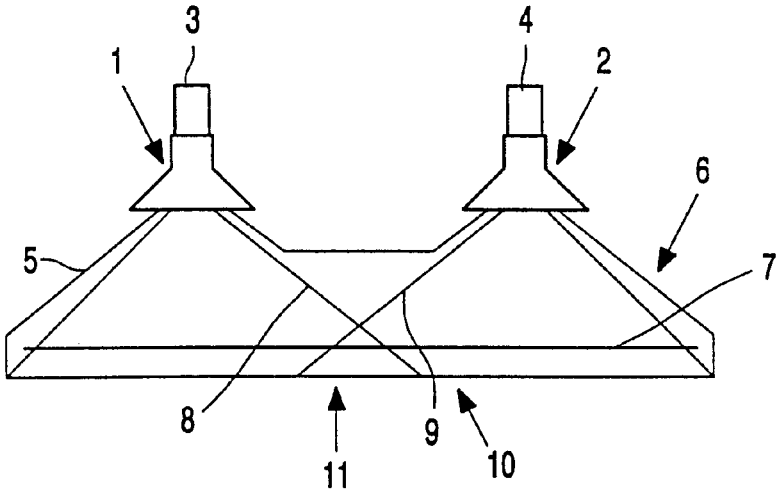
FIG. 1 shows a color display device in accordance with the invention.

FIG. 1 shows a top view of the "Camel" CRT. Visible are two deflection yokes 1 and 2 positioned around necks 3 and 4, two partial cones 5 and 6, which are part of one envelope within which one shadow mask 7 is present and the scanning areas of the beams 8 and 9 on luminescent screen 10 of the tube. The figure also shows that there is an overlap area 11 for the images created by the two yokes.

Figure 3:
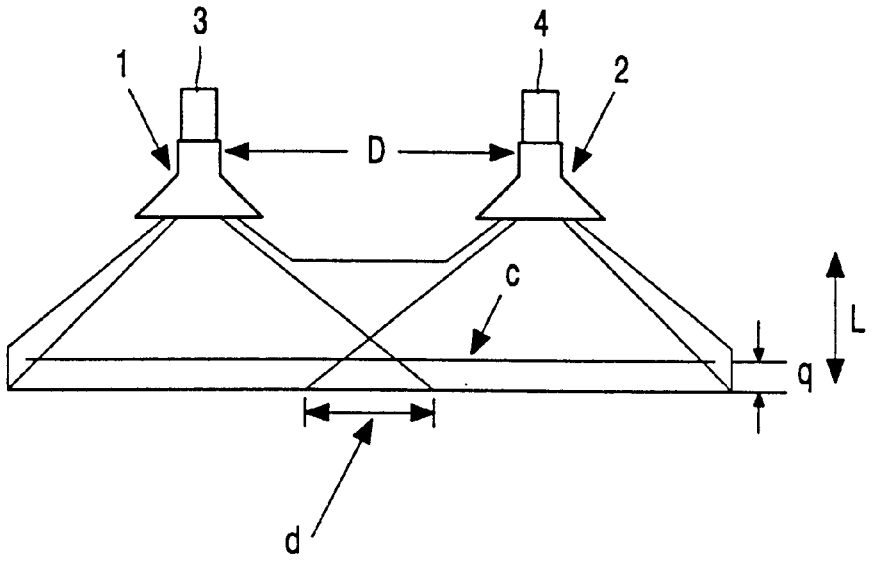
FIG. 3 shows relation between the width of the overlap area and other parameters.

For the camel CRT there are two options for the orientation of the guns and the shadow mask. In one option the guns are in-line guns with their orientation in the horizontal direction as shown in Figure. w in which a front view of a Camel CRT with a horizontal orientation of the guns leading to vertical phosphor lines 14 as in conventional CRT's is shown. In neck 3 an electron gun 12 is provided for generating three electron beams 21, 22 and 23. In neck 4 an electron gun 13 is provided for generating three electron beams 24, 25 and 26. FIG. 3 shows a criterion for the distance between the necks of the tube, in relation to the mask to screen distance and the screen pitch at the center of the screen.

Figure 4:
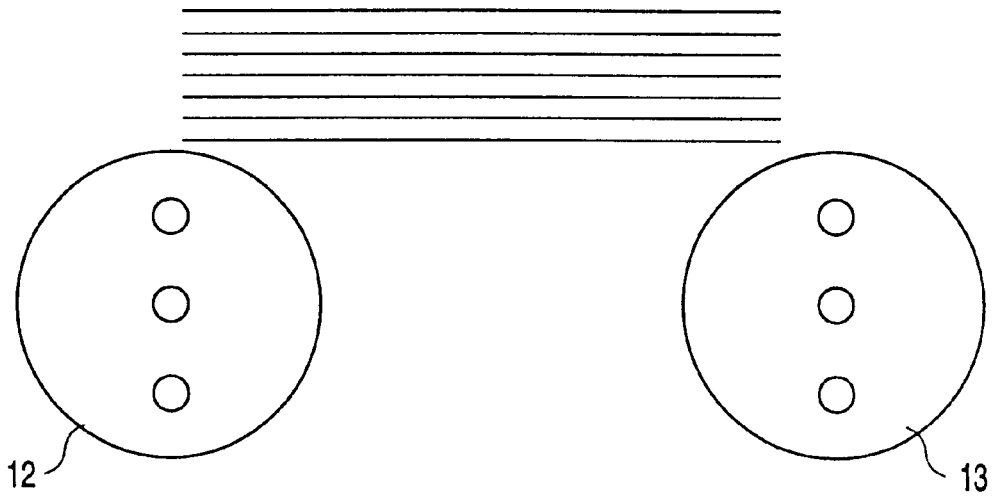
FIG. 4 shows schematically a further possible arrangement of the electron beams and the phosphor lines.

In an other option, the guns, phosphor lines and shadow mask are rotated over 90°, as shown in FIG. 4. In this embodiment the apertures of the gun are arranged in a vertical orientation while horizontally oriented phosphor lines are used.

Figure 2:
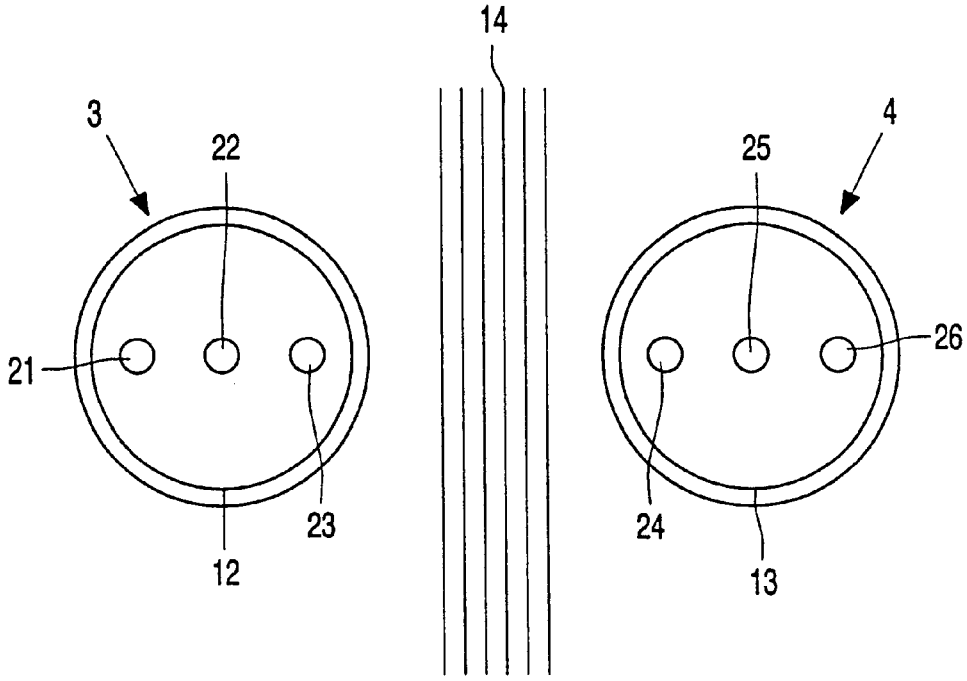
FIG. 2 shows schematically a possible arrangement of the electron beams and the phosphor lines.

In one embodiment the guns, the phosphor lines and mask have an orientation like those normally used in TV tubes and shown in FIG. 2. Then it is necessary that the distance between the necks of the guns is chosen according to the following rule: When the center beams of the two sets of yokes go through one and the same hole in the shadow mask, both beams must reach a green phosphor line. This means that the distance d between the landing points of these two beams on the screen must be an integer times the screen pitch. This distance d is determined by the distance D between the tube necks and the distance q (at the screen center) between the mask and the screen. From FIG. 3 it follows that D/d=(L−q)/q where L is the distance to the deflection point of the deflection unit and the screen.

In a second embodiment the electron beams of each of the two guns are positioned above each other as shown in FIG. 4. In this embodiment the phosphor lines are oriented horizontally (also shown in FIG. 4) and the line shaped mask holes are oriented in the horizontal direction. In this embodiment overlap of the two images is possible without color purity problems. As a result in this embodiment there is no requirement for specific distances between the two necks of the gun.

In this embodiment there are two ways of scanning. One way is to scan horizontally, as normally done in a TV set. However, that can contribute to scan moire. Therefore it is preferred to scan vertically (line scan vertical, field scan horizontally). In this arrangement it is advantageous if the field deflection coils are driven in an anti-phase mode, which means that, in operation, they are scanning in opposing directions. The result is that both of the sub-images are writing in the overlap area simultaneously. The timing of the deflection currents is such that in the overlap area the beams from both sides are writing the same image at a time difference no more than one or two line periods. One advantage is that the DC offset of the frame deflection coils can be used for amending the overlap of the sub-images. It is also advantageous to use the trapezium correction (normally used for East/West trapezium distortions) to eliminate the trapezium distortions arising from the curvature of the screen.

An advantage of using frame coils in anti-phase, or line deflection coils in anti-phase when normal, not rotated, scanning directions are used, is that stray fields generated by the frame, respectively line deflection coils are in anti-phase. The stray fields cancel each other to a large degree, which makes it easier to comply with e.g. legal restrictions on stray fields generated by the device. This advantage is not dependent on the use of a shadow mask and could be useful for instance also a display device having two necks and two electron guns using the index tube principle.

In all embodiments, the overlap of the images can be optimized by making a gradual variation of the intensities of the beams. As a result the right image has no intensity at the left side of the overlap and a full intensity at the right end of the overlap. For the left image, the image has no intensity at the right end of the overlap and full intensity at the left end of the overlap. The best results are obtained by using within the overlap area the following intensity functions:

$$I_{left\text{-}beams}=(0.5-0.5f(x))*I_{original}$$

$$I_{right\text{-}beams}=(0.5+0.5f(x))*I_{original}$$

in which:

$I_{original}$=beam current needed for the local image when there would not have been an overlap in that point x=the horizontal position relative to the center of overlap d=the width of the overlap.

f(x)=a function of x, where f(0)=0 and f(x)=−f(−x) and f(d/2)=1

Two possible functions are:

$$f(x)=\sin(\pi x/d)$$

$$f(x)=(2x/d)^2*\operatorname{sign}(x)$$

The voltage driving the gun can be derived from these functions taking the g of the gun (which stands for the non-linearity of the gun) into account.

One criterion for calculating the required accuracy with which the two images created by the two guns must coincide is the luminance variation that results from a stitch error (not exact coincidence). The effect of a stitch error e (i.e. one of the image is displaced by a distance e from the ideal position relative to the other image) can be calculated by shifting the left image by a distance e/2 to the right and the right image by a distance e/2 to the left. The intensity error at the center of the overlap area is given by:

f(e/2). The maximum image intensity error is for the two exemplary functions $\sin(\pi x/2d)I_{original}$ and $(x/d)^2 I_{original}$ respectively.

For a 5% limit for the luminance variation a stitching error of 1 mm is allowable for a 30 mm overlap. Preferably the overlap region are has a width d between 10 and 40 mm. For an overlap shorter than 10 mm stitching errors are difficult to avoid. In the middle of the screen the phosphor pitch will be approximately constant. As the electron beams are scanned to the outerlimits of the scan (i.e. near and at the overlap area) there should, however, be a small phosphor pitch variation. This variation is of opposite sign for the left and right beams. By keeping the overlap to less than or equal to 40 mm problems relating to the above, to some extent contradictory, requirements on the phosphor pitch are kept within reasonable bounds.

Figure 5:
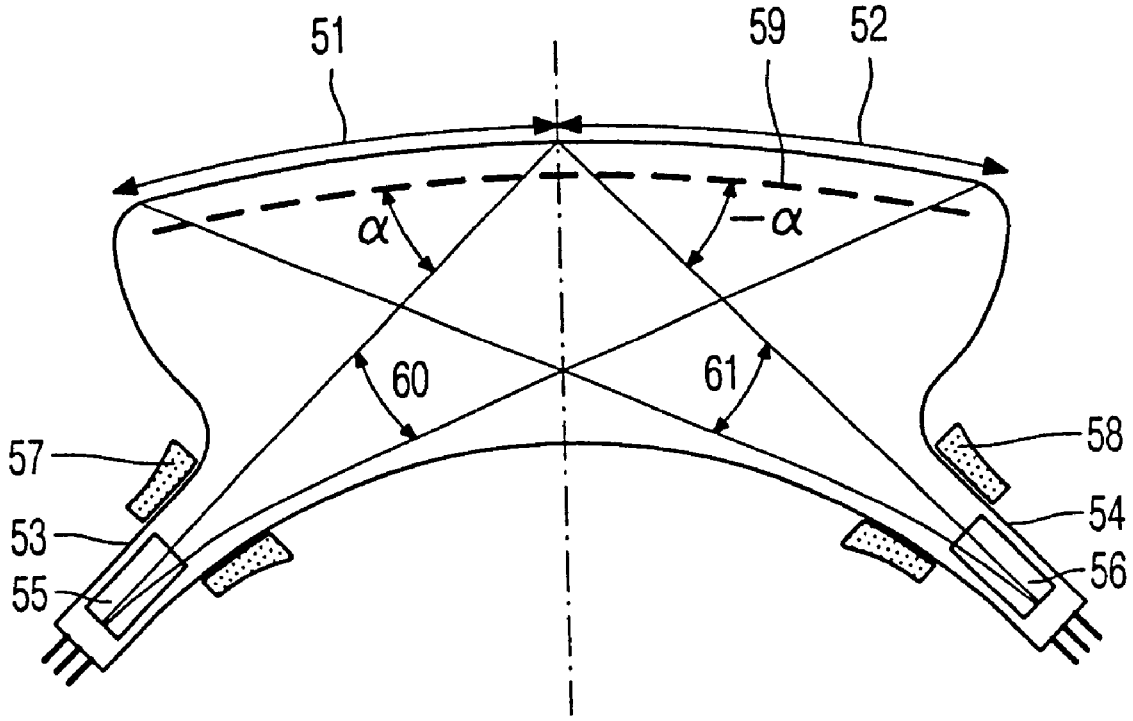
FIG. 5 shows schematically a further embodiment of a color display device in accordance with the invention.

Within the concept of the invention many variations are possible. FIG. 5 shows a variation. The color display device comprises, as the device shown in FIG. 1, two sub-regions 51, 52 and two necks 53, 54 in each neck an electron gun 55, 56 and around each neck a deflection yoke 57, 58. The necks are arranged at an angle with respect to the shadowmask 59, such that the electron beam 60 is scanned over sub-region 52 and electron beam 62 is scanned over sub-region 51. This arrangement has the advantages that the cathode ray tube device is shallower, i.e. the distance between the neck(s) and the front end of the cathode ray tube is reduced. Furthermore the angle of deflection is reduced, which reduces the deflection energy, and the distances between the deflection units is increased, which decreases the possibility of one deflection unit influencing the other deflection unit. In this embodiment the necks are thus arranged at opposite, shallow angles α, −α with respect to the shadow mask.

What is claimed is:

1. A color cathode ray tube device comprising a cathode ray tube having a single screen section divided into two sub-regions only, and means for separately scanning the sub-regions, characterized in that:

said two sub-regions are adjoining sub-regions, each of said sub-regions has one overlap region associated therewith where the two sub-regions overlap, the cathode ray tube comprises one color selection electrode only, and a plurality of respective necks, deflection yokes and electron guns arranged to emit electron beams which lie substantially in a same plane when not deflected, said screen is elongated in a direction from one of said sub-regions to the other of said sub-regions, thereby defining a longer screen dimension and a shorter screen dimension, each of said electron guns and deflection yokes scans all of a respective one only of said sub-regions and the overlap region, and the color selection electrode is a shadowmask, said electron guns lie in a plane parallel to the longer screen dimension, and said electron guns and the respective necks are arranged at opposite angles ($\alpha$, $-\alpha$) with respect to the shadowmask.

2. A color cathode ray tube device comprising a cathode ray tube having a single screen section divided into a plurality of sub-regions, and means for separately scanning the sub-regions, characterized in that:

each of said sub-regions has at least one overlap region associated therewith where one sub-region and an adjoining sub-region overlap, two of said sub-regions overlap one other sub-region only, the cathode ray tube comprises one color selection electrode only, and a plurality of respective necks, deflection yokes and electron guns arranged to emit electron beams which lie substantially in a same plane when not deflected, and each of said electron guns and deflection yokes scans all of a respective one only of said sub-regions, and the overlap regions associated with the respective one only of said sub-regions, and the device comprises means for effecting a gradual variation of intensity of the electron beams from the respective electron guns of the adjoining sub-regions across an overlap region.

3. A device as claimed in claim 2, characterized in that each overlap region has a width d, where 10 mm$\leqq$d$\leqq$40 mm.

4. A device as claimed in claim 2, characterized in that the means for effecting comprises means for driving the cathode ray tube such that the beam intensities in an overlap region are modulated according to $I_{left\text{-}beams}=(0.5-0.5\ f(X))*I_{original}$ $I_{right\text{-}beams}=(0.5+0.5\ f(X))*I_{original}$ in which:

$I_{original}$=beam current needed for a local image in absence of overlap at that point x=horizontal position relative to the center of overlap d=width of the overlap f(x)=a function of x, where f(0)=0, f(x)=−f(−x), and f(d/2)=1.

5. A device as claimed in claim 2, further comprising means for supplying deflection currents to the deflection units, characterized in that timing of the deflection currents is such that in at least one overlap region the beams from the adjoining sub-regions are writing a same image at a time difference of no more than one or two line periods.

6. A color cathode ray tube device comprising a cathode ray tube having a single screen section divided into a plurality of sub-regions, and means for separately scanning the sub-regions, characterized in that:

each of said sub-regions has at least one overlap region associated therewith where one sub-region and an adjoining sub-region overlap, two of said sub-regions overlap one other sub-region only, the cathode ray tube comprises one color selection electrode only, and a plurality of respective necks, deflection yokes and electron guns arranged to emit electron beams which lie substantially in a same plane when not deflected, and each of said electron guns and deflection yokes scans all of a respective one only of said sub-regions, and the overlap regions associated with the respective one only of said sub-regions, wherein the color selection electrode is a mask having a multiplicity of mask holes, each electron gun is an in-line electron gun for generating a respective center and two outer beams, and the screen comprises a phosphor pattern comprising phosphor areas for different colors, characterized in that a distance (D) between the necks, a mask to screen distance (q) and a screen pitch are chosen such that when the center beams of two guns go through a same mask hole in an overlap region both beams reach a phosphor area of the same color.

7. A device as claimed in claim 6, characterized in that the screen is divided into three sub-regions only, one of said sub-regions being a central sub-region overlapping each of the other sub-regions.

8. A device as claimed in claim 6, characterized in that the screen is divided into two sub-regions only, said screen is elongated in a direction from one of said sub-regions to the other of said sub-regions, thereby defining a longer screen dimension and a shorter screen dimension, said deflection units comprise respective line deflection coils and field deflection coils, and said device further comprises means for supplying respective line deflection currents and field deflection currents to the deflection units, characterized in that during operation one of said deflection currents is supplied to the respective deflection units with opposite phases.

9. A device as claimed in claim 6, characterized in that said screen is elongated in a direction from one of said two of said sub-regions to the other of said two of said sub-regions, thereby defining a longer screen dimension and a shorter screen dimension, said screen has a phosphor line structure parallel to said longer screen dimension, and said electron guns are in-line electron guns each having a respective center beam and two outer beams oriented in a respective plane perpendicular to the phosphor lines.

10. A device as claimed in claim 9, characterized in that the device comprises means for line-scanning in the direction of said shorter screen dimension.

11. A device as claimed in claim 6, characterized in that each overlap region has a width d, where 10 mm$\leqq$d$\leqq$40 mm.

12. A device as claimed in claim 11, characterized in that the device comprises means for effecting a gradual variation of intensity of the electron beams from the respective electron guns of the adjoining sub-regions across an overlap region.

13. A device as claimed in claim 6, characterized in that the screen is divided into two sub-regions only, and said screen is elongated in a direction from one of said sub-regions to the other of said sub-regions, thereby defining a longer screen dimension and a shorter screen dimension.

14. A device as claimed in claim 13, characterized in that said screen is elongated in a direction from one of said two of said sub-regions to the other of said two of said sub-regions, thereby defining a longer screen dimension and a shorter screen dimension, said screen has a phosphor line structure parallel to said longer screen dimension, and said electron guns are in-line electron guns each having a respective center beam and two outer beams oriented in a respective plane perpendicular to the phosphor lines.

15. A device as claimed in claim 14, characterized in that the device comprises means for line-scanning in the direction of said shorter screen dimension.

* * * * *